United States Patent [19]

Stepan

[11] Patent Number: 4,507,809

[45] Date of Patent: Apr. 2, 1985

[54] VISOR FOR A PROTECTIVE HELMET

[75] Inventor: Walter Stepan, Allersberg, Fed. Rep. of Germany

[73] Assignee: Uvex Winter Optik GmbH, Fürth, Fed. Rep. of Germany

[21] Appl. No.: 449,754

[22] Filed: Dec. 14, 1982

[30] Foreign Application Priority Data

Dec. 23, 1981 [DE] Fed. Rep. of Germany ... 8137527[U]

[51] Int. Cl.[3] ..... A42B 3/02

[52] U.S. Cl. ..... 2/424

[58] Field of Search ..... 2/424, 10, 6, 8, 9, 2/425, 441, 443, 410

[56] References Cited

U.S. PATENT DOCUMENTS 2,391,361 12/1945 Stevenson ..... 2/441

2,469,810 5/1949 Bowers ..... 2/8

3,945,043 3/1976 DeAngelis ..... 2/8

*Primary Examiner*—Peter Nerbun

*Attorney, Agent, or Firm*—Browdy and Neimark

[57] ABSTRACT

A visor for a protective helmet, the visor comprising at least one transparent panel and a frame which receives substantially the entire periphery of the panel in a groove, recess, or the like carried by the frame in a manner which permits rapid changing of the transparent panel. The frame comprises at least two frame parts pivotably connected with one another. In a closed position of the frame, these frame parts can be firmly connected to one another, while in a pivoted position of at least one frame part, the transparent panel can be removed from the groove recess, or the like.

3 Claims, 4 Drawing Figures

VISOR FOR A PROTECTIVE HELMET

FIELD OF THE INVENTION

The present invention relates to a visor for a protective helmet; the visor has at least one transparent panel and a frame receiving the panel within a continuous groove, recess or the like.

BACKGROUND OF THE INVENTION

In a visor of this kind, known from German Design Pat. No. 75 29 457, the transparent panel is held in a nonreleasable manner in a frame. In order to impart the required stability to the transparent panel, the panel is adapted to the curvature of the frame, which is dictated by the external shape of the protective helmet.

Transparent panels of this kind may be made of hard, scratch-resistant mineral glass, as in the case of German Design Pat. No. 75 29 457, or—as is much more widespread in practice—of a transparent plastic. Plastic, however, is far less scratch-resistant than mineral glass.

It is further known, for instance from German Design Pat. No. 78 10 225, to embody a visor panel entirely of a plastic that is as scratch-resistant as possible and is screwed directly onto the protective helmet. Visor panels of this kind, which are not received in frames, must from the outset have a curvature corresponding to the external contour of the protective helmet in the vicinity of its view opening; that is, they must be produced by injection molding and are necessarily relatively thick.

It is common to all these embodiments that the transparent panel can be replaced only with the exertion of some effort, and that in particular the transprent panel itself is relatively expensive in terms of effort and accordingly of cost. It is impossible to make a rapid change during a brief pause while driving in order to exchange a dirty transparent panel for a clean one.

SUMMARY OF THE INVENTION

It is accordingly the object of the present invention to provide a visor of the general type described herein before which is constructed in such manner that a quick change of the transparent panel is possible.

This object is attained in accordance with the invention by providing a frame made up of at least two parts, connected to one another in a pivotable manner. In a closed position of the frame, the parts can be connected with one another in a fixed position, while in a pivoted position of least one part of the frame, the transparent panel can be removed from the groove, recess or the like.

In accordance with the invention it is possible to remove the transparent panel from the groove or the like of one frame part whenever the other part of the frame has been pivoted out of the closed position. When the frame parts are in a firmly connected position, there is thus a fully closed frame, which holds the panel as firmly as is the case with the conventional closed frame. Pivoting one frame part away from the other is accomplished quite rapidly, so that it is easy for the user to replace a dirty panel, even during a brief pause while driving. With the embodiment according to the invention, it is possible to produce the transparent panel of very thin, sheet-like material, for instance by a stamping procedure, so that the panel is also extraordinarily inexpensive.

The transparent panel does not need to have any inherent rigidity, so that not only can it be embodied as very much thinner than conventional panels, but also it does not have to be injection molded in a curved shape, which is particularly advantageous. When the frame is in the open position, the transparent panel is simply inserted into the other frame part or equally simply removed from it.

The provision of a lock for the two frame parts means on the one hand that when the frame is closed, a completely solid connection is attainable between the frame parts; on the other hand, the lock can be released at either side with a simple hand movement. When the frame parts are each embodied with a pivot bearing at either side, it is possible to embody the two frame parts as relatively simple injection-molded plastic parts. The provision of a locking bar in one pivot bearing part that engages a recess in the other assures not only that the locking bars intended for locking the frame parts together are easily accessible to the user, but also that particularly reliable locking of the two frame parts when the frame is closed is attained.

Stop faces which limit the maximum pivoting arc of the pivot bearings make it easier to open the frame and replace a transparent panel.

The structure of the visor is made simpler if common axes are provided for the pivot bearing parts and the fastening screw at either side of the helmet.

Further advantages and characteristics of the invention will become apparent from the following description of an exemplary embodiment taken together with the drawings.

DESCRIPTION OF THE PREFERRED EMBODIMENT

Figure 1:
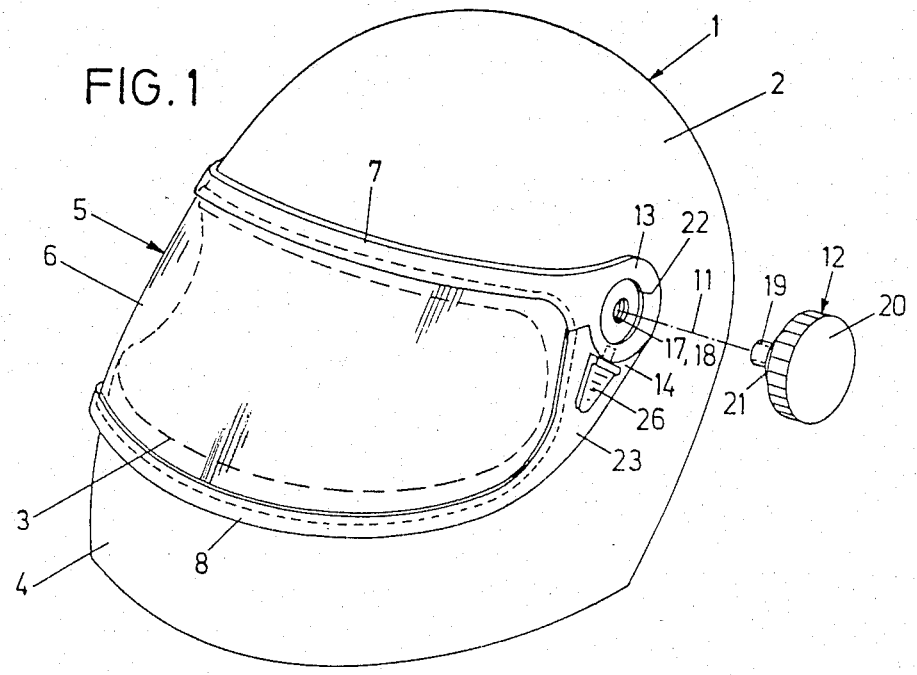
FIG. 1 shows a protective helmet having a visor according to the present invention, with the frame in the closed position and seen in a perspective view.

The protective helmet 1, embodied as a motorcycle crash helmet, has a hard-elastic outer shell 2, which may be formed of injection molded fiberglass-reinforced plastic for example. At the front and at the front portion of each side, the helmet has a view opening 3 piercing it completely; the opening is defined at the bottom by a chin protector bracket 4, which as a rule is embodied in one piece with the outer shell 2. The view opening 3 is covered by a visor 5, which will now be described in detail.

The visor 5 substantially comprises a transparent panel 6 and a frame receiving it, the frame being embodied by an upper frame part 7 and a lower frame part 8. In the closed state of this frame, as shown in FIG. 1, the entire periphery of the transparent panel 6 is received in and held firmly in place by a corresponding groove 9 in the frame parts 7, 8, the groove 9 being U-shaped in cross section.

In order to assure play-free positioning of the transparent panel 6 in the frame parts 7, 8, so that it will not be loose or have play, a strip 10 of elastic sealing material is disposed in the bottom of each groove 9. The two frame parts 7, 8 are embodied such that they are pivotable relative to one another, specifically about a pivotal axis 11, which coincides with the axis of fastening screws 12 by means of which the visor 5 is secured to the outer shell 2. The entire visor 5 can be pivoted about this pivotal axis 11 into a position closing the view opening 3 (FIG. 1) or into an upwardly pivoted position—not shown in the drawing—which uncovers the view opening 3; the visor 5 can be clamped firmly in either one of these positions by means of the fastening screws 12 attached at either side.

The two frame parts 7 and 8 are provided at their ends with respective flat pivot bearing parts 13 and 14, which rest against one another. The pivot bearing part 13 of the upper frame part 7 laps over the pivot bearing part 14 of the lower frame part 8 at the top with a guide rim 15, while the pivot bearing part 14 of the lower frame part 8 engages the other pivot bearing part 13 at the bottom with a guide rim 16. The pivot bearing parts 13, 14 are provided with concentric bores 17, 18, through which the threaded tang 19 of the fastening screw 12 is passed. A washer-like collar 21 is formed on the handle part 20 of the fastening screw 12, engaging a corresponding washer-shaped recess 22 in the pivot bearing part 13; as a result, firstly the pivot bearing parts 13, 14 and thus the frame parts 7, 8 as well are connected substantially without play with the fastening screws 12 and thus with the outer shell 2; and, secondly, it is attained that the visor 5 is pressed over a large surface area against the outer shell 2 of the helmet, so that the visor is firmly connected with the outer shell 2, especially in the position which closes the view opening 3.

Figure 2:
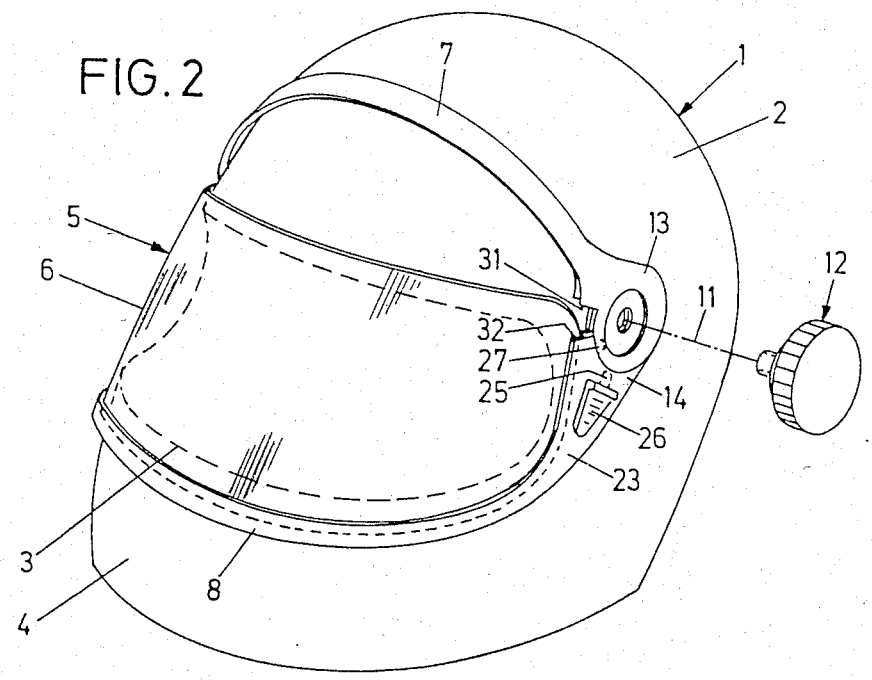
FIG. 2 shows a protective helmet according to FIG. 1 with the frame of the visor in the open position.
Figure 3:
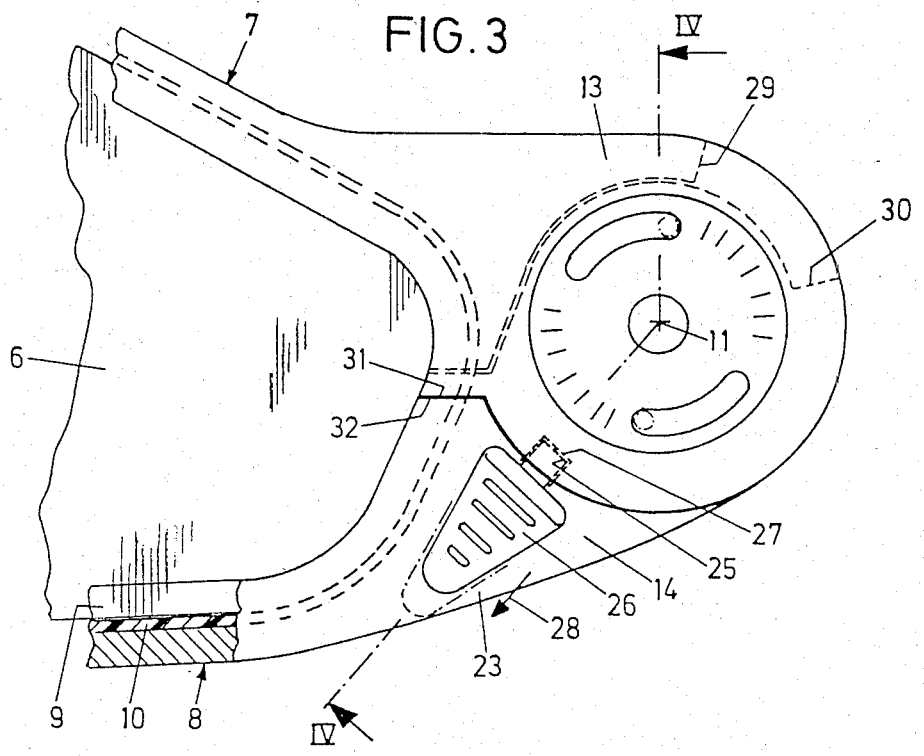
FIG. 3 is a partial plan view on one pivot bearing area of the visor, shown on an enlarged scale.
Figure 4:
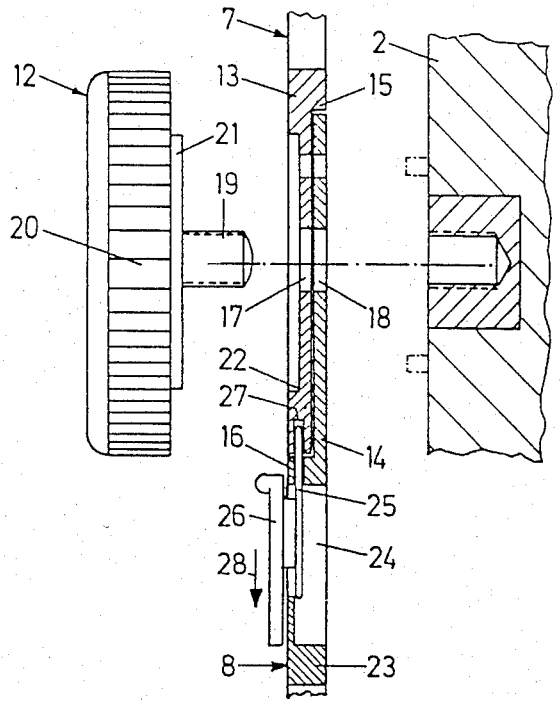
FIG. 4 is a section taken through the pivot bearing area with locking bar along the line IV—IV of FIG. 3.

The pivot bearing part 14 of the lower frame part 8 merges in a transitional zone 23 with the lower portion of lower frame part 8. Embodied in this transitional zone 23 is a guide slit 24, in which a locking bar 25 is disposed in a displaceable manner; the locking bar 25 is firmly connected with an external operator member 26 which can be slidably moved to move locking bar 25. Associated with the locking bar 25 is a recess 27 in the pivot bearing part 13 of the upper frame part, into which recess the locking bar 25 can be inserted, as shown in FIGS. 1, 3 and 4. In this locked position of the two pivot bearing parts 13, 14, they are no longer pivotable relative to one another; thus in this position the upper frame part 7 and the lower frame part 8 are united into one closed frame. If in contrast the locking bar 25 is displaced into the position indicated by dashed lines in FIG. 3, by the corresponding displacement of the sliding operator member 26 in the direction 28, that is toward the bottom and toward the inside, then the locking bar 25 is removed from the recess 27 in the pivot bearing part 13. In this unlocked position, perhaps after the fastening screws 12 have been loosened slightly, the upper frame part 7 can be pivoted into the upper pivoted position shown in FIG. 2, as a result of which the transparent panel 6 becomes free at the top edge thereof. Panel 6 can then be removed upward out of the groove 9 of the lower frame part 8 and replaced as needed with another transparent panel 6, which is inserted from the top into the groove in a corresponding manner. In order to limit the pivoting movement of the upper frame part 7 relative to the lower frame part 8 to approximately the dimension shown in FIG. 2, stop faces 29, 30 are provided on the sides of the pivot bearing parts 13, 14 oriented toward the outer shell 2. These stop faces 29, 30 extend radially with respect to the pivoting axis 11 and are disposed at an angle of approximately 20°–30° to one another; in the upwardly pivoted position of the upper frame part 7 shown in FIG. 2, these stop faces come to rest against one another and accordingly limit the pivoting movement.

As is seen particularly in FIG. 3, the direction of displacement of the locking bar 25 passes through the pivotal axis 11.

In the position of the two frame parts 7, 8 in which they form a closed frame (FIG. 1), these two frame parts 7, 8 rest with contact faces 31, 32 (FIG. 2) against one another in the vicinity of the groove 9, so that forces, such as wind, which engage the visor 5 from the front and thus, because of its location toward the bottom and front, primarily engage the lower frame part 8, are not transmitted by means of the locking bar 25 but instead are transmitted directly via the contact faces 31, 32.

The frame parts 7, 8 are produced of some suitable plastic, such as polyamide, reinforced as needed with fiberglass. They are rigid and relatively tough, and they may be embodied with flat surfaces, because the respective section of the frame between the pivot bearing parts 13 on the upper frame part 7 and 14 on the lower frame part 8, which is curved, is embodied as relatively thin. The result is particularly simple manufacture.

The transparent panel 6 is flat in embodiment; thus it may be stamped from plate-like material. This plate-like material is relatively thin, having a thickness by way of example of 1.0 to 1.5 mm. Polycarbonate is a possible material for the transparent panel, and various shadings may be provided for different light conditions.

Instead of only one panel, it is also possible for a plurality of transparent panels, in particular two, comprising an inner and an outer transparent panel, both being supported in the frame made up of the upper frame part 7 and the lower frame part 8; in that case, a corresponding number of grooves 9 is provided, such as a groove for the inner transparent panel and a groove for the outer transparent panel. Various combinations of colors of the materials making up the transparent panels, and especially various combinations of materials themselves can be provided in that case. For instance, the outer transparent panel may be of scratch-resistant material, while the inner transparent panel may have an anti-fogging embodiment. The transparent panels may furthermore be made of a polarizing material or may have different wall thicknesses. The number of possible combinations is virtually arbitrary. Naturally, it is also possible where a plurality of transparent panels are provided, such as inner and outer panels, to change only one transparent panel at a time.

It is to be understood that the foregoing text and drawings relate to an embodiment of the invention given by way of example but not limitation. Various other embodiments and variants are possible within the spirit and scope of the invention.

What is claimed is:

1. In combination with a motorcycle protective helmet including a head-covering shell, a visor having at least one transparent panel and a frame with a groove, recess or the like all around for receiving the panel, comprising:

said frame including at least two pivotably interconnected frame parts and means for securely locking said frame parts together when the frame is in a panel retaining position, at least one frame part being pivotably mounted, relative to, and into overlying relationship with, said helmet shell, so that said transparent panel can be removed from the groove, recess or the like, said frame parts each including lateral portions having pivot bearing means resting against one another and pivotable relative to one another, and a locking bar slidably supported by one frame part in the area of one pivot bearing means and slidable into a recess in the other pivot bearing means.

2. A visor as defined in claim 1 characterized in that said two pivot bearing means are provided with cooperating stop faces limiting the maximum pivotal arc of said two frame parts relative to each other.

3. A visor as defined in claim 1 in which the pivot bearing means on a given side of said visor includes a lateral bore for receiving a fastening element which secures said visor to said helmet, said lateral bore and said pivotal bearing means on said given side of said visor lying on a common pivotal axis.

* * * * *